US006987367B2

(12) United States Patent
Ono et al.

(10) Patent No.: US 6,987,367 B2
(45) Date of Patent: Jan. 17, 2006

(54) CATHODE-RAY TUBE

(75) Inventors: Osamu Ono, Ibaraki (JP); Shigeru Sugawara, Ibaraki (JP); Toshio Shimaoogi, Ibaraki (JP); Tomoyuki Hayama, Ibaraki (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 23 days.

(21) Appl. No.: 10/849,005

(22) Filed: May 20, 2004

(65) Prior Publication Data

US 2004/0251836 A1 Dec. 16, 2004

(30) Foreign Application Priority Data

Jun. 10, 2003 (JP) ..... 2003-165151

(51) Int. Cl.
*G09G 1/04* (2006.01)

(52) U.S. Cl. ..... 315/382; 315/411; 315/368.15; 313/414; 313/449

(58) Field of Classification Search ..... 315/14–16, 315/364, 366, 368.15, 368.16, 382, 382.1, 315/411; 313/409–415, 417, 421, 437–442, 313/446–449, 452

See application file for complete search history.

(56) References Cited

U.S. PATENT DOCUMENTS

| | | | | |
|---|---|---|---|---|
| 4,742,279 A * | 5/1988 | Gerritsen et al. | ..... | 315/382 |
| 4,935,663 A * | 6/1990 | Shimoma et al. | ..... | 313/412 |
| 4,967,120 A * | 10/1990 | Katsuma et al. | ..... | 315/382 |
| 5,262,702 A * | 11/1993 | Shimoma et al. | ..... | 315/382 |

FOREIGN PATENT DOCUMENTS

| | | |
|---|---|---|
| JP | 48-38973 | 6/1973 |
| JP | 50-158274 | 12/1975 |
| JP | 2000-331624 | 11/2000 |

* cited by examiner

*Primary Examiner*—Haissa Philogene
(74) *Attorney, Agent, or Firm*—Oblon, Spivak, McClelland, Maier & Neustadt, P.C.

(57) ABSTRACT

A prefocus lens section in an electron gun assembly includes a second grid that is disposed on an electron beam generating section side, a third grid that is disposed on a main lens section side, and a shield grid that is disposed between the second grid and the third grid. The shield grid is a cup-shaped electrode with a side wall that surrounds an outer peripheral part of the third grid, which part is located on the second grid side, and extends in parallel to a tube axis. The shield grid has a bottom surface disposed to face the second grid and has an open end disposed to face the third grid. A relationship, Ec<Vf<Er, is established, where Ec is a potential applied to the second grid, Vf is a potential applied to the shield grid, and Er is a potential applied to the third grid.

14 Claims, 4 Drawing Sheets

CATHODE-RAY TUBE

CROSS-REFERENCE TO RELATED APPLICATIONS

This application is based upon and claims the benefit of priority from prior Japanese Patent Application No. 2003-165151, filed Jun. 10, 2003, the entire contents of which are incorporated herein by reference.

BACKGROUND OF THE INVENTION

1. Field of the Invention

The present invention relates generally to a cathode-ray tube with an electron gun assembly that emits at least one electron beam, and more particularly to a cathode-ray tube capable of improving focus characteristics of the electron beam and realizing a high resolution over the entirety of a screen.

2. Description of the Related Art

A currently predominant self-convergence in-line color cathode-ray tube includes an in-line electron gun assembly that emits three electron beams, which are horizontally arranged in line. The electron gun assembly includes an electron beam generating section that emits electron beams, a prefocus lens section that prefocuses the electron beams emitted by the electron beam generating section, and a main lens section that ultimately focuses the electron beams prefocused by the prefocus lens section onto a phosphor screen.

In general terms, the resolution of a color cathode-ray tube varies depending on the size and shape of a beam spot on the phosphor screen. In order to improve the resolution, it is thus necessary to form on the phosphor screen a beam spot having a minimum size and a circular shape with little deformation.

As a method of forming a small beam spot on the phosphor screen, it is effective to increase the lens power of the prefocus lens section and decrease the divergence angle of the electron beam that enters the main lens section. In order to increase the lens power of the prefocus lens section, it is necessary to make the potential of one of grids, which constitute the prefocus lens section, higher than the potential of the other grid, thereby providing a large potential difference between the grids of the prefocus lens section. However, from the standpoint of withstand voltage characteristics between neck pins, there are restrictions on the supply of high potential from the outside.

A method for solving this problem has been proposed, wherein a grid of the prefocus lens section is supplied with a high potential via a resistor that is disposed within the cathode-ray tube, thereby reducing the beam spot size. Jpn. Pat. Appln. KOKAI Publication No. 2000-331624, for instance, discloses an electron gun assembly comprising cathodes, a first grid, a second grid, a third grid, a fourth grid, a fifth grid, a sixth grid, a seventh grid, and a resistor disposed near these grids. The third grid is supplied with a voltage via the resistor, which is higher than a focus voltage and lower than an anode voltage. In this way, the third grid is supplied with a high potential within the cathode-ray tube. Hence, without degrading the withstand voltage characteristics between neck pins, the lens power of the prefocus lens section that is created by the second grid and third grid can be increased and the size of the beam spot formed on the phosphor screen can be reduced.

The electron gun assembly with the above-described structure, however, has the following problem.

In usual cases, a voltage of several-hundred V is applied to the second grid, and a voltage of 6 to 9 kV is applied to the third grid. The potential difference between the second grid and third grid is large. In order to further increase the lens power of the prefocus lens section, it is necessary to provide a still larger potential difference between the second grid and the third grid. This may lead to deterioration in withstand voltage characteristics between the grids that constitute the prefocus lens section. In addition, the cathodes are present near the prefocus lens section. The cathodes emit a great number of thermoelectrons, and produces a high-temperature environment. In consideration of the withstand voltage characteristics, a very undesirable environment does exit.

If a still higher potential than in usual cases is applied to the third grid in the electron gun assembly, the withstand voltage characteristics between the second grid and third grid deteriorate. Furthermore, owing to the rise in neck potential, the withstand voltage characteristics in the range between the cathodes and third grid also deteriorate. Consequently, the cathodes may be damaged due to discharge, or the resolution may be degraded by a voltage variation due to leak current. In worst cases, the cathode-ray tube may be destroyed due to discharge.

BRIEF SUMMARY OF THE INVENTION

The present invention has been made in order to solve the above-described problems, and its object is to provide a cathode-ray tube that can enhance the resolution and has high quality and high reliability.

According to an aspect of the present invention, there is provided a cathode-ray tube comprising an electron gun assembly having an electron beam generating section that generates an electron beam, a prefocus lens section that prefocuses the electron beam generated from the electron beam generating section, and a main lens section that focuses the electron beam, which is prefocused by the prefocus lens section, onto a phosphor screen, wherein the prefocus lens section includes at least a first prefocus electrode that is disposed on the electron beam generating section side, a second prefocus electrode that is disposed on the main lens section side, and an auxiliary electrode that is disposed between the first prefocus electrode and the second prefocus electrode, the auxiliary electrode is a cup-shaped electrode with a side wall that surrounds an outer peripheral part of the second prefocus electrode, which part is located on the first prefocus electrode side, and extends in parallel to a tube axis, and the auxiliary electrode has a bottom surface disposed to face the first prefocus electrode and has an open portion disposed to face the second prefocus electrode, and a relationship, $E1<Es<E2$, is established, where E1 is a potential applied to the first prefocus electrode, E2 is a potential applied to the second prefocus electrode, and Es is a potential applied to the auxiliary electrode.

According to this cathode-ray tube, a large potential difference is provided between the first prefocus electrode and second prefocus electrode of the prefocus lens section, and the lens power of the prefocus lens section is increased. Hence, the size of the beam spot can be reduced over the entire phosphor screen, and the resolution of the cathode-ray tube can be improved.

In addition, according to this cathode-ray tube, the first prefocus electrode-side part of the second prefocus electrode, which is supplied with a high potential, is surrounded by the cup-shaped auxiliary electrode. Moreover, the relationship, $E1<Es<E2$, is established, where E1 is a potential applied to the first prefocus-electrode, E2 is a potential applied-to the second prefocus electrode, and Es is a potential applied to the auxiliary electrode. Thereby, even if the grids are closely arranged within the limited space of the neck, withstand voltage characteristics are not degraded and an undesirable discharge or variation in application voltage can be prevented. Therefore, the cathode-ray tube with high quality and high reliability can be provided.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the embodiments given below, serve to explain the principles of the invention.

DETAILED DESCRIPTION OF THE INVENTION

A cathode-ray tube according to an embodiment of the present invention will now be described with reference to the accompanying drawings.

Figure 1:
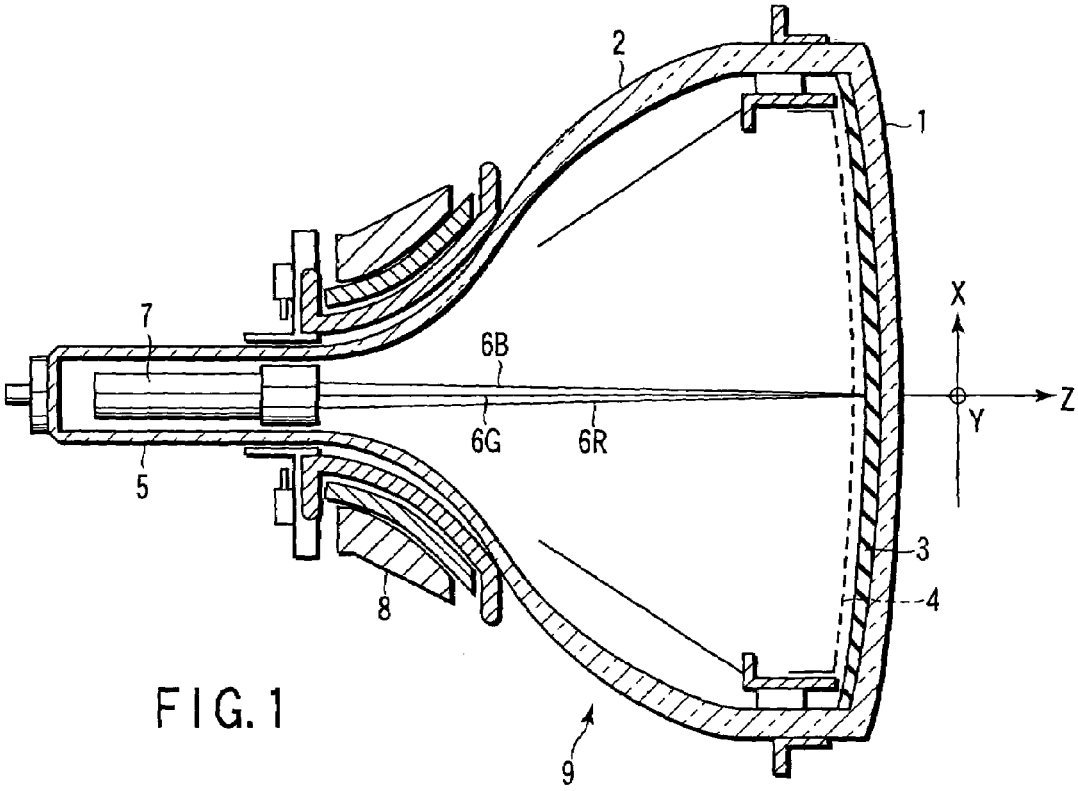
FIG. 1 is a horizontal cross-sectional view that schematically shows the structure of a color cathode-ray tube apparatus according to an embodiment of the present invention;.

As is shown in FIG. 1, a cathode-ray tube apparatus, that is, a self-convergence type in-line color cathode-ray tube apparatus, has a vacuum envelope 9. The vacuum envelope 9 includes a panel 1 and a funnel 2 integrally coupled to the panel 1. A phosphor screen 3 is disposed on an inside surface of the panel 1. The phosphor screen 3 has three-color striped or dot-shaped phosphor layers, which emit blue, green and red light. A shadow mask 4 is disposed to face the phosphor screen 3. The shadow mask 4 has many apertures in its inside part.

An in-line electron gun assembly 7 is disposed within a cylindrical neck 5, which corresponds to a small-diameter portion of the funnel 2. The electron gun assembly 7 emits three in-line electron beams 6B, 6G and 6R (i.e. a center beam 6G and side beams 6B and 6R) which are arranged in line and travel in the same horizontal plane.

A deflection yoke 8 is disposed to extend from a large-diameter portion of the funnel 2 to the neck 5. The deflection yoke 8 generates non-uniform deflection magnetic fields for deflecting the three electron beams 6B, 6G and 6R, which have been emitted from the electron gun assembly 7, in a horizontal direction (X) and a vertical direction (Y). The non-uniform deflection magnetic fields comprise a pincushion-shaped horizontal deflection magnetic field and a barrel-shaped vertical deflection magnetic field.

In this cathode-ray tube apparatus with the above structure, the three electron beams 6B, 6G and 6R emitted from the electron gun assembly 7 are converged toward the phosphor screen 3 and focused on the associated color phosphor layers on the phosphor screen 3. The three electron beams 6B, 6G and 6R are deflected by the non-uniform deflection magnetic fields generated by the deflection yoke 8 and scanned over the phosphor screen 3 through the shadow mask 4 in the horizontal direction X and vertical direction Y. Thus, a color image is displayed.

Figure 2:
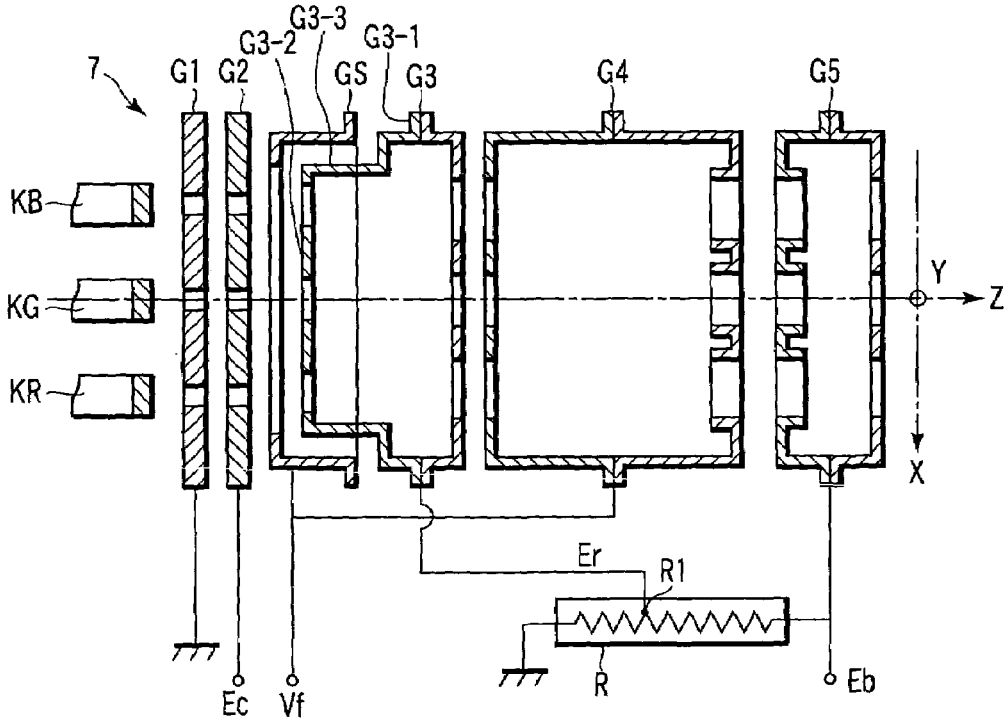
FIG. 2 is a horizontal cross-sectional view that schematically shows the structure of an electron gun assembly, which is applicable to the cathode-ray tube apparatus shown in FIG. 1.

As is shown in FIG. 2, the electron gun assembly 7 includes three cathodes K (R, G, B) arranged in line in the horizontal direction X, three heaters that individually heat the cathodes K (R, G, B), and six electrodes. The six electrodes, that is, a first grid G1, a second grid (first prefocus electrode) G2, a shield grid (auxiliary electrode) GS, a third grid (second prefocus electrode) G3, a fourth grid (focus electrode) G4 and a fifth grid (anode electrode) G5, are successively arranged from the cathode K (R, G, B) side toward the phosphor screen in a tube axis direction Z. The cathodes K (R, G, B) and the six electrodes are integrally supported and fixed by a pair of insulation support members.

The first grid G1 and second grid G2 are formed of thin plate electrodes. Each of the plate electrodes has, in its plate face, three electron beam passage holes that are arranged in line in the horizontal direction X in association with the three cathodes K (R, G, B). Each of the three electron beam passage holes has a small-diameter circular shape.

Each of the third grid G3, fourth grid G4 and fifth grid G5 comprises integrally formed cylindrical electrodes. Specifically, these cylindrical electrodes are cup-shaped electrodes, whose open portions are abutted on each other. The third grid G3 has, in its surface opposed to the second grid G2, three electron beam passage holes that are arranged in line in the horizontal direction X in association with the three cathodes K (R, G, B). Each of these three electron beam passage holes has a circular shape with a slightly greater diameter than the diameter of each of the electron beam passage holes formed in the second grid G2. In addition, the third grid G3 has, in its surface opposed to the fourth grid G4, three electron beam passage holes that are arranged in line in the horizontal direction X in association with the three cathodes K (R, G, B). Each of these three electron beam passage holes has a large-diameter circular shape.

The fourth grid G4 has, in each of its surfaces opposed to the third grid G3 and the fifth grid G5, three electron beam passage holes that are arranged in line in the horizontal direction X in association with the three cathodes K (R, G, B). Each of these three electron beam passage holes has a large-diameter circular shape. The fifth grid G5 has, in each of its surfaces opposed to the fourth grid G4 and the phosphor screen, three electron beam passage holes that are arranged in line in the horizontal direction X in association with the three cathodes K (R, G, B). Each of these three electron beam passage holes has a large-diameter circular shape.

Figure 3A:
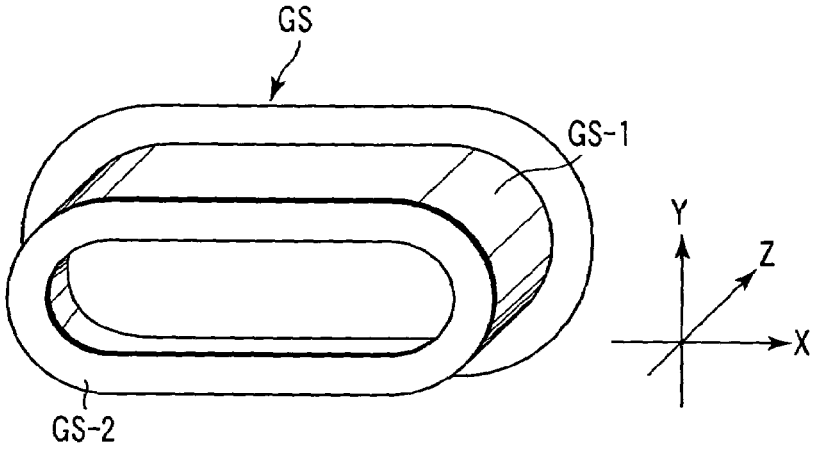
FIG. 3A is a perspective view that schematically shows the structure of a shield grid that is applied to the electron gun assembly shown in FIG. 2.
Figure 3B:
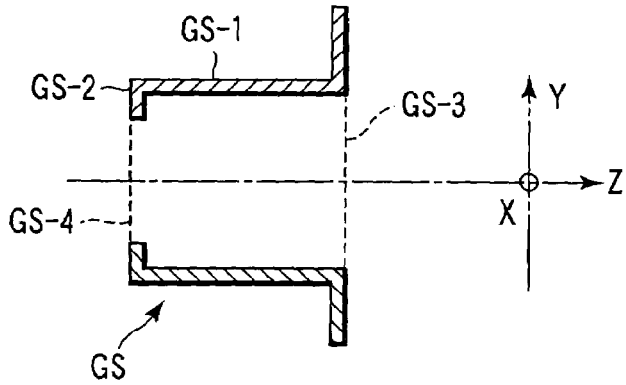
FIG. 3B is a cross-sectional view that schematically shows a cross-sectional structure of the shield grid shown in FIG. 3A.

The shield grid GS, as shown in FIGS. 3A and 3B, comprises a cup-shaped electrode. The cup-shaped electrode includes a side wall GS-1 that surrounds an outer peripheral part of the third grid G3, which part is located on the second grid G2 side, and extends in parallel to the tube-axis direction Z. The cup-shaped electrode has a bottom surface GS-2 disposed to face the second grid G2, and has an open portion GS-3 disposed to face the third grid G3. In addition, the cup-shaped electrode has, in its face opposed to the second grid G2, that is, in its bottom surface GS-2, an electron beam passage hole GS-4 that commonly passes the three electron beams. The electron beam passage hole GS-4 has an oval shape, that is, a track shape, which has a major axis in the direction of arrangement of the three electron beams, that is, in the horizontal direction X.

The open portion GS-3 of the cup-shaped electrode, which constitutes the shield grid GS, has an inside diameter that is greater than the outside diameter of a distal end portion G3-3 including at least a bottom surface portion G3-2 of the cup-shaped electrode G3-1, which is located on the second grid G2 side of the third grid G3. Thus, when the cup-shaped electrode G3-1 of the third grid G3 is inserted in the open portion GS-3 of the shield grid GS, the distal end portion G3-3 of the third grid G3 does not contact the shield grid GS. In short, a predetermined gap is provided between the side wall GS-1 and bottom surface GS-2 of the shield grid GS, on the one hand, and the distal end portion G3-3 and bottom surface portion G3-2 of the third grid G3, on the other hand.

A resistor R is disposed near the electron gun assembly 7 within the neck 5. One end of the resistor R is electrically connected to the fifth grid GS, and the other end of the resistor R is grounded. An output terminal R1 provided at a predetermined position on an intermediate portion of the resistor R is connected to the third grid G3.

In the electron gun assembly 7 with the above-described structure, a modulation signal (drive voltage), which is obtained by superimposing a video signal on a DC voltage of about 50 to 200V, is applied to the cathodes K (R, G, B). The first grid G1 is grounded. The second grid G2 is supplied with a DC voltage Ec of about 300 to 1000V (e.g. 800V).

A fixed focus voltage Vf of about 6 to 10 kV is applied to the fourth grid G4. The shield electrode GS is electrically connected to the fourth grid G4 within the tube and is supplied with the same-level focus voltage Vf (e.g. 8 kV) as is applied to the fourth grid G4. An anode voltage Eb of about 20 to 35 kV is applied to the fifth grid G5.

A division voltage Er that is divided by the resistor R is applied to the third grid G3. The division voltage has a level between the focus voltage Vf and anode voltage Eb. The voltage Er applied to the third grid G3 is less than about 70% of the anode voltage Eb, for example, a fixed voltage of about 13 to 22 kV (e.g. 15 kV). If the voltage Er that is applied to the third grid G3 is too high, withstand voltage characteristics are degraded. If the voltage Er is set at less than about 70% of the anode voltage Eb, substantially the same withstand voltage characteristics as in the prior art can be secured. It is desirable, therefore, to set the voltage Er applied to the third grid G3 at less than about 70% of the anode voltage Eb.

Hence, the relationship, $Ec<Vf<Er$, is established between the voltage Ec applied to the second grid G2, the voltage Vf applied to the shield grid GS and the voltage Er applied to the third grid G3.

In the electron gun assembly 7, the above-mentioned voltages are applied to the respective grids, thereby constituting an electron beam generating section, a prefocus lens section, a sub-lens section, and a main lens section. To be more specific, the electron beam generating section is formed by the cathodes K, first grid G1 and second grid G2. The electron beam generating section generates electron beams and forms a cross-over of each electron beam. The prefocus lens section is formed by the second grid G2, shield grid GS and third grid G3. The prefocus lens section accelerates and prefocuses electron beams that are generated from the electron beam generating section.

The sub-lens section is formed by the third grid G3 and fourth grid G4. The sub-lens section further prefocuses the electron beams that are prefocused by the prefocus lens section. The main lens section is formed by the fourth grid G4 and fifth grid G5. The main lens section accelerates the electron beams, which are prefocused by the sub-lens section, and ultimately focuses them on the phosphor screen.

According to the electron gun assembly 7, a voltage, which is higher than a normal level, is applied via the resistor R to the third grid G3, and a large potential difference is provided between the second grid G2 and third grid G3. Accordingly, the lens power of the prefocus lens section is increased. Hence, the divergence angle of each electron beam 6 (R, G, B), which enters the main lens section, is decreased, and the size of the beam spot can be reduced over the entire phosphor screen 3. Therefore, the resolution of the cathode-ray tube can be improved.

In addition, according to the electron gun assembly 7, the shield grid GS is disposed between the second grid G2 and third grid G3. The shield grid GS is so disposed as to surround the outer periphery of the second grid-side part of the third grid G3. The shield grid GS has, in its surface opposed to the second grid G2, the common electron beam passage hole at the passage region of the three electron beams so as not to affect the lens function of the prefocus lens section. The shield grid GS is supplied with the voltage Vf that is higher than the voltage Ec applied to the second grid G2 and lower than the voltage Er applied to the third grid G3.

In particular, when the focus voltage is applied to the shield grid GS that is adjacent to the second grid G2, the potential difference between the second grid G2 and shield grid GS becomes substantially the same as in the prior art. Thus, good withstand voltage characteristics between the second grid G2 and third grid G3 can be maintained. Besides, the neck potential in the region between the cathodes K and the second grid G2 can be kept at substantially the same level as in the prior art, since the second grid G2-side part of the high-potential third grid G3 is covered with the shield grid GS. According to the electron gun assembly 7, therefore, the quality and reliability of the cathode-ray tube can be improved without degrading the withstand voltage characteristics.

The present invention is not limited to the above-described embodiment. Various modifications can be made. In the embodiment, for example, the shield grid GS that is applied to the electron gun assembly 7 has the structure as shown in FIG. 3A and FIG. 3B. The structure of the shield grid GS is not limited to this. It is important to choose a proper structure in consideration of the structures of the adjacent second grid G2 and third grid G3, and the interval between the grids.

Figure 4A:
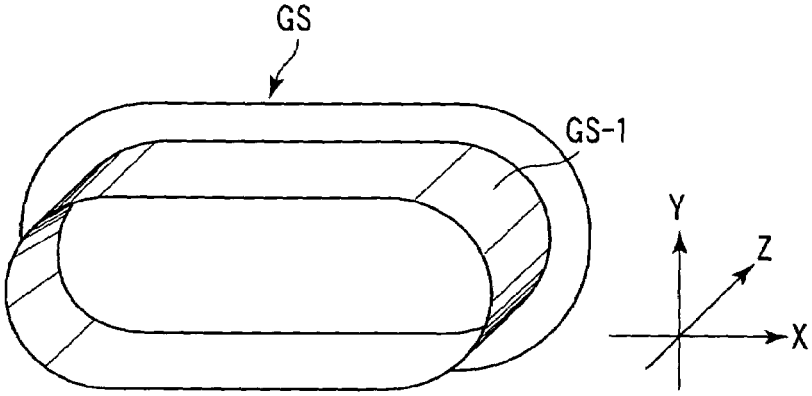
FIG. 4A is a perspective view that schematically shows the structure of another shield grid, which is applicable to the electron gun assembly shown in FIG. 2.
Figure 4B:
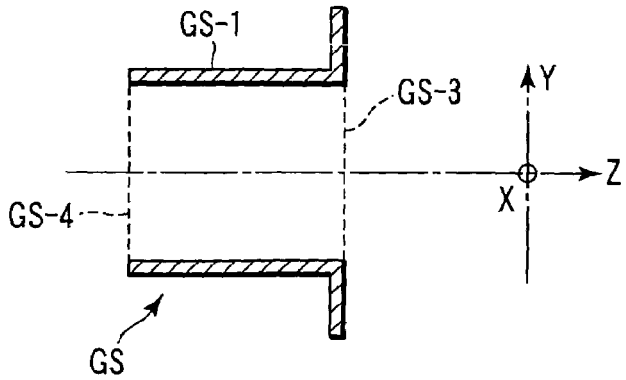
FIG. 4B is a cross-sectional view that schematically shows a cross-sectional structure of the shield grid shown in FIG. 4A.

The shield grid GS may be formed of a cup-shaped electrode, as is shown in FIG. 4A and FIG. 4B. The cup-shaped electrode includes a side wall GS-1 that surrounds an outer peripheral part of the third grid G3, which part is located on the second grid G2 side, and extends in parallel to the tube-axis direction Z. In addition, the cup-shaped electrode has an open portion GS-3 disposed to face the third grid G3. The cup-shaped electrode has, in its face opposed to the second grid G2, an electron beam passage hole GS-4 that commonly passes the three electron beams. In this example, the cup-shaped electrode does not have an edge portion corresponding to the bottom surface thereof. The electron beam passage hole GS-4 has an oval shape, that is, a track shape, which has a major axis in the horizontal direction X.

Figure 5A:
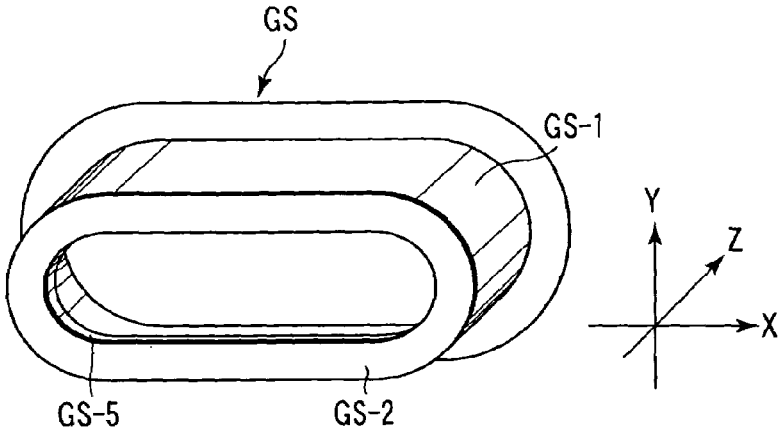
FIG. 5A is a perspective view that schematically shows the structure of another shield grid, which is applicable to the electron gun assembly shown in FIG. 2.
Figure 5B:
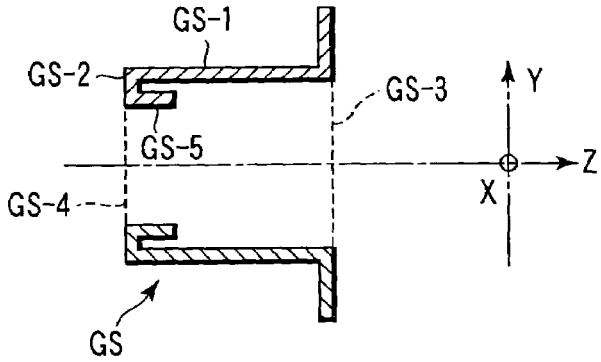
FIG. 5B is a cross-sectional view that schematically shows a cross-sectional structure of the shield grid shown in FIG. 5A.

The shield grid GS may be formed of a cup-shaped electrode, as is shown in FIG. 5A and FIG. 5B. The cup-shaped electrode includes a side wall GS-1 that surrounds an outer peripheral part of the third grid G3, which part is located on the second grid G2 side, and extends in parallel to the tube axis Z. The cup-shaped electrode has a bottom surface GS-2 disposed to face the second grid G2, and an open portion GS-3 disposed to face the third grid G3. In addition, the cup-shaped electrode has, in its face opposed to the second grid G2, an electron beam passage hole GS-4 that commonly passes the three electron beams. The electron beam passage hole GS-4 has an oval shape, that is, a track shape, which has a major axis in the horizontal direction X. This cup-shaped electrode has a side wall GS-5 that extends in parallel to the tube axis Z from the electron beam passage hole GS-4 toward the open portion GS-3.

Even where the shield grid GS having the structure as shown in FIGS. 4A and 4B or FIGS. 5A and 5B is used, the same advantages as with the above-described embodiment are obtained.

In the above-described embodiment, the electron gun assembly 7 includes the main lens section that is created by fixed voltages applied to the two grids, i.e. the fourth grid G4 and fifth grid G5. The electron gun assembly, however, may have other structures. For instance, the electron gun assembly may be configured to form a quadrupole lens within the main lens section.

Figure 6:
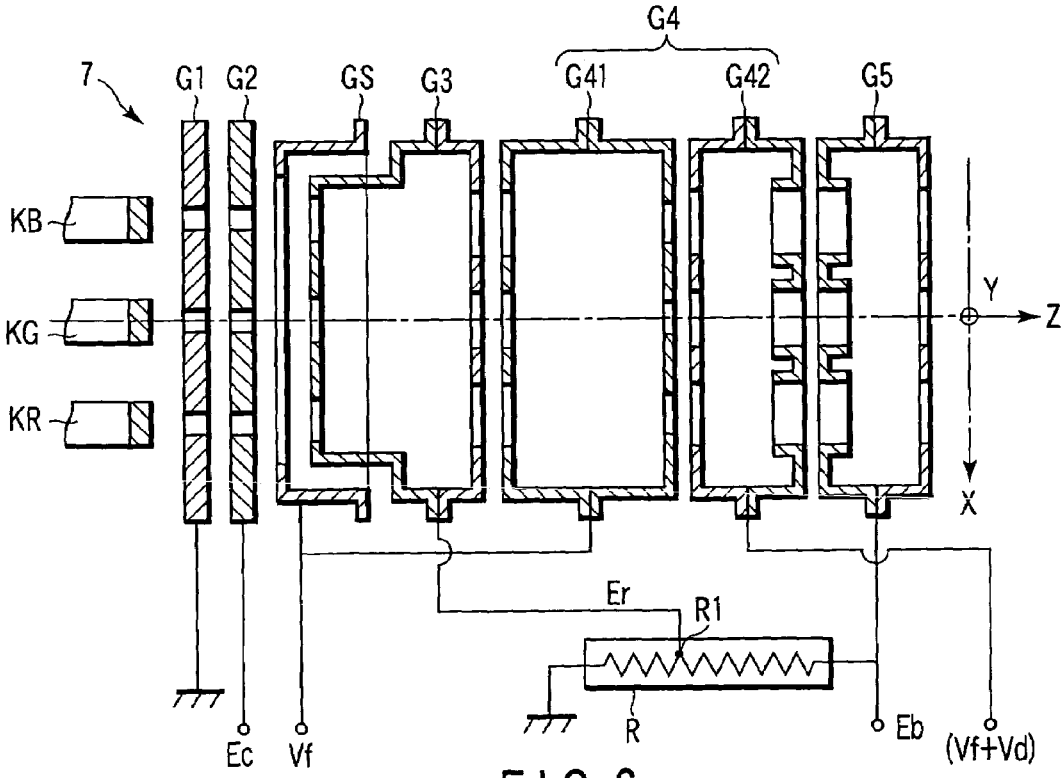
FIG. 6 is a horizontal cross-sectional view that schematically shows the structure of another electron gun assembly, which is applicable to the cathode-ray tube apparatus shown in FIG. 1.

FIG. 6 shows a main lens section that is created by a fourth grid G4 including two segments G41 and G42, and a fifth grid G5. The first segment G41 of the fourth grid G4 has, in its face opposed to the second segment G42, three electron beam passage holes each having, e.g. a vertically elongated shape with a major axis in the vertical direction Y. The second segment G42 of the fourth grid G4 has, in its face opposed to the first segment G41, three electron beam passage holes each having, e.g. a horizontally elongated shape with a major axis in the horizontal direction X.

The first segment G41 is supplied with a predetermined DC voltage Vf. The second segment G42 is supplied with a dynamic focus voltage (Vf+Vd) that is obtained by superimposing a parabolically varying AC voltage component Vd on a predetermined DC voltage Vf. The fifth grid G5 is supplied with an anode voltage Eb. This dynamic focus voltage (Vf+Vd) varies in synchronism with a saw-tooth deflection current in a parabolic fashion in accordance with a variation in deflection amount of electron beams.

A quadrupole lens is created when a potential difference is provided between the first segment G41 and the second segment G42. In addition to the advantages of the electron gun assembly with the above-described structure, the addition of the quadrupole lens makes it possible to dynamically compensate deflection aberration and to form a beam spot with less deformation on the entire phosphor screen.

Figure 7:
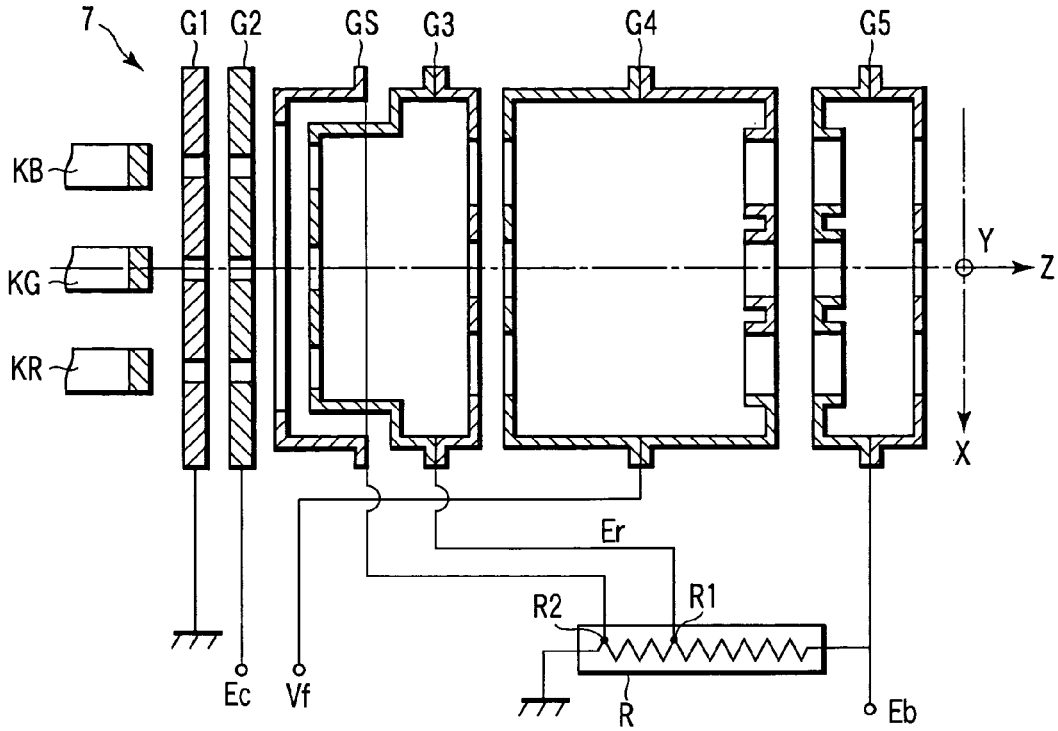
FIG. 7 is a horizontal cross-sectional view that schematically shows the structure of still another electron gun assembly, which is applicable to the cathode-ray tube apparatus shown in FIG. 1.

In the above-described embodiment, the shield grid GS is supplied with the focus voltage Vf that is commonly applied to the fourth grid G4. Alternatively, the shield grid GS may be supplied with a voltage by another method. For example, as shown in FIG. 7, the shield grid GS may be connected to an output terminal R2 of the resistor R, which provides a lower voltage than the output terminal R1. The shield grid GS is supplied with a predetermined division voltage of about 4 to 10 kV.

In the above-described embodiment, the electron beam passage hole formed in each grid has a nearly circular shape. Alternatively, the electron beam passage hole may have a right-angled tetragonal shape such as a square or a rectangle, or a horizontally or vertically elongated oval shape. Additionally, a slit may be formed at a peripheral region of the electron beam passage hole.

The above-described embodiment is directed to the in-line color cathode-ray tube apparatus. However, since the above-described electron gun assembly is configured to form three independent electron lenses for three electron beams, this electron gun assembly is applicable to a delta color cathode-ray tube apparatus. Furthermore, this invention is applicable to other types of cathode-ray tube apparatus, such as a black-and-white cathode-ray tube that emits a single electron beam.

Another embodiment of the present invention is described below.

Figure 8:
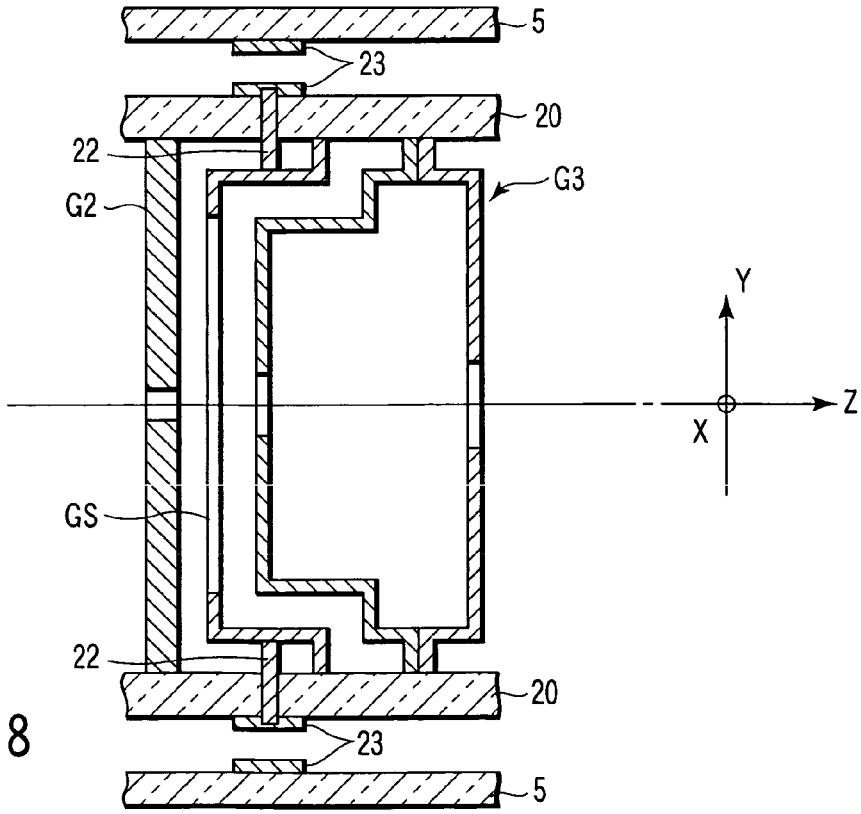
FIG. 8 is a vertical cross-sectional view that schematically shows the structure of still another electron gun assembly, which is applicable to the cathode-ray tube apparatus shown in FIG. 1.

The pair of insulation support members 20, which integrally support and fix the cathodes and electrodes, are rod-shaped members extending in the tube-axis direction Z, as shown in FIG. 8. The electron gun assembly 7 includes electrically conductive ribbons 22 that surround the insulation support members 20 between the insulation support members 20 and the neck 5 in the vicinity of the shield grid GS. Each conductive ribbon 22 is electrically connected to the shield grid GS. The conductive ribbons 22 are disposed to surround the paired insulation support members 20, respectively. The conductive ribbon 22 has, for instance, an annular shape. The conductive ribbon 22 extends from one end of the shield grid GS, passes over that surface of the insulation support member 20, which is opposed to the neck 5, and reaches the other end of the shield grid GS.

In the vicinity of the conductive ribbons 22, electrically conductive films 23 are formed on the surfaces of the insulation support members 20 (i.e. those surfaces of the insulation support members 20, which are opposed to the neck 5) and on the surface of the neck (i.e. that surface of the neck 5, which is opposed to the insulation support members 20). These conductive films 23 are formed, for example, by depositing a metal material, such as stainless steel, on the associated parts.

With this embodiment, the same advantages as with the preceding embodiments can be obtained. Additionally, the conductive films 23 formed on the surfaces of the insulation support members 20 and neck 5 are supplied with the same focus voltage as in the prior art via the conductive ribbons 22. Therefore, more stability in potential can be achieved than in the prior art. According to the electron gun assembly 7, still better withstand voltage characteristics are obtained and the quality and reliability of the cathode-ray tube can further be improved.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A cathode-ray tube comprising an electron gun assembly having an electron beam generating section that generates an electron beam, a prefocus lens section that prefocuses the electron beam generated from the electron beam generating section, and a main lens section that focuses the electron beam, which is prefocused by the prefocus lens section, onto a phosphor screen, wherein the prefocus lens section includes at least a first prefocus electrode that is disposed on the electron beam generating section side, a second prefocus electrode that is disposed on the main lens section side, and an auxiliary electrode that is disposed between the first prefocus electrode and the second prefocus electrode, the auxiliary electrode is a cup-shaped electrode with a side wall that surrounds an outer peripheral part of the second prefocus electrode, which part is located on the first prefocus electrode side, and extends in parallel to a tube axis, and the auxiliary electrode has a bottom surface disposed to face the first prefocus electrode and has an open portion disposed to face the second prefocus electrode, and a relationship, $E1<Es<E2$, is established, where E1 is a potential applied to the first prefocus electrode, E2 is a potential applied to the second prefocus electrode, and Es is a potential applied to the auxiliary electrode.

2. The cathode-ray tube according to claim 1, further comprising a resistor that is disposed near the electron gun assembly, wherein a division voltage that is divided by the resistor is applied to the second prefocus electrode.

3. The cathode-ray tube according to claim 1, wherein the potential E2 that is applied to the second prefocus electrode is about 70% or less of an anode voltage that is applied to an anode electrode included in the main lens section.

4. The cathode-ray tube according to claim 1, wherein the electron gun assembly includes the electron beam generating section that generates a plurality of electron beams arranged in line in a horizontal direction, and the bottom surface of the auxiliary electrode has an electron beam passage hole that commonly passes the plurality of electron beams and has a major axis in the horizontal direction.

5. The cathode-ray tube according to claim 4, wherein said bottom surface includes a side wall that extends from the electron beam passage hole toward the open portion in parallel to the tube axis.

6. The cathode-ray tube according to claim 1, wherein the main lens section includes at least a focus electrode, to which a dynamic focus voltage that is obtained by superimposing a parabolically varying AC voltage component on a predetermined DC voltage is applied, and an anode electrode to which an anode voltage is applied, and a quadrupole lens is created within the main lens section.

7. The cathode-ray tube according to claim 1, further comprising a resistor that is disposed near the electron gun assembly, wherein a division voltage that is divided by the resistor is applied to the auxiliary electrode.

8. A cathode-ray tube comprising an electron gun assembly having an electron beam generating section that generates an electron beam, a prefocus lens section that prefocuses the electron beam generated from the electron beam generating section, a main lens section that focuses the electron beam, which is prefocused by the prefocus lens section, onto a phosphor screen, and an insulation support member that supports and fixes cathodes and electrodes, which constitute said sections, wherein the prefocus lens section includes at least a first prefocus electrode that is disposed on the electron beam generating section side, a second prefocus electrode that is disposed on the main lens section side, and an auxiliary electrode that is disposed between the first prefocus electrode and the second prefocus electrode, the auxiliary electrode is a cup-shaped electrode with a side wall that surrounds an outer peripheral part of the second prefocus electrode, which part is located on the first prefocus electrode side, and extends in parallel to a tube axis, and the auxiliary electrode has a bottom surface disposed to face the first prefocus electrode and has an open portion disposed to face the second prefocus electrode, the cathode-ray tube includes an electrically conductive ribbon that surrounds the insulation support member in the vicinity of the auxiliary electrode, the electrically conductive ribbon being connected to the auxiliary electrode, and electrically conductive films that are formed, in the vicinity of the electrically conductive ribbon, on a surface of the insulation support member, which is opposed to a neck, and on a surface of the neck, which is opposed to the insulation support member, and a relationship, $E1<Es<E2$, is established, where E1 is a potential applied to the first prefocus electrode, E2 is a potential applied to the second prefocus electrode, and Es is a potential applied to the auxiliary electrode.

9. The cathode-ray tube according to claim 8, further comprising a resistor that is disposed near the electron gun assembly, wherein a division voltage that is divided by the resistor is applied to the second prefocus electrode.

10. The cathode-ray tube according to claim 8, wherein the potential E2 that is applied to the second prefocus electrode is about 70% or less of an anode voltage that is applied to an anode electrode included in the main lens section.

11. The cathode-ray tube according to claim 8, wherein the electron gun assembly includes the electron beam generating section that generates a plurality of electron beams arranged in line in a horizontal direction, and the bottom surface of the auxiliary electrode has an electron beam passage hole that commonly passes the plurality of electron beams and has a major axis in the horizontal direction.

12. The cathode-ray tube according to claim 11, wherein said bottom surface includes a side wall that extends from the electron beam passage hole toward the open portion in parallel to the tube axis.

13. The cathode-ray tube according to claim 8, wherein the main lens section includes at least a focus electrode, to which a dynamic focus voltage that is obtained by superimposing a parabolically varying AC voltage component on a predetermined DC voltage is applied, and an anode electrode to which an anode voltage is applied, and a quadrupole lens is created within the main lens section.

14. The cathode-ray tube according to claim 8, further comprising a resistor that is disposed near the electron gun assembly, wherein a division voltage that is divided by the resistor is applied to the auxiliary electrode.

* * * * *